US006718559B1

(12) United States Patent
Davidson

(10) Patent No.: US 6,718,559 B1
(45) Date of Patent: Apr. 13, 2004

(54) MOTORCYCLE HELMUT SNAP-ON DECORATIVE DEVICE

(76) Inventor: Howard Davidson, 1565 E. 35th St., Brooklyn, NY (US) 11234

( * ) Notice: Subject to any disclaimer, the term of this patent is extended or adjusted under 35 U.S.C. 154(b) by 0 days.

(21) Appl. No.: 10/066,347

(22) Filed: Jan. 31, 2002

(51) Int. Cl.[7] ..... A42B 1/24; G09F 3/00; A41F 1/00

(52) U.S. Cl. ..... 2/422; 2/209.13; 2/246; 40/315; 40/329; 24/114.4; 24/324; 24/619; 24/662

(58) Field of Search ..... 2/422, 209.13, 2/10, 244, 246, 6.2, 424; 40/329, 662, 315; 24/619, 681, 627, 324, 662, 663, 108, 107, 113 R, 113 MP, 114.4, 114.5

(56) References Cited

U.S. PATENT DOCUMENTS

| | | | | | |
|---|---|---|---|---|---|
| 799,997 | A | * | 9/1905 | MacLellan | 40/662 |
| 1,485,724 | A | * | 3/1924 | Scully | 24/681 |
| 2,146,047 | A | * | 2/1939 | Bangs | 40/622 |
| 3,428,963 | A | * | 2/1969 | Centeck | 2/133 |
| 3,965,952 | A | * | 6/1976 | Rivman et al. | 383/86 |
| 4,023,210 | A | * | 5/1977 | Hanson | 2/10 |
| 4,097,930 | A | * | 7/1978 | Bay | 2/10 |
| 4,156,292 | A | | 5/1979 | Helm et al. | |
| 4,222,125 | A | | 9/1980 | Sewell-Wood | |
| 4,333,180 | A | * | 6/1982 | Bay | 2/10 |
| 5,136,726 | A | * | 8/1992 | Kellin et al. | 2/244 |
| 5,259,096 | A | * | 11/1993 | Grant | 24/324 |
| 5,276,985 | A | * | 1/1994 | Halloran | 40/329 |
| 5,282,278 | A | | 2/1994 | Miner | |
| 5,442,817 | A | | 8/1995 | Miner | |
| 5,542,157 | A | | 8/1996 | Herman | |
| 5,673,501 | A | * | 10/1997 | Mathews | 36/136 |
| 5,729,833 | A | | 3/1998 | Judge | |
| 5,803,266 | A | | 9/1998 | Blackwelder | |
| 5,896,587 | A | * | 4/1999 | Gentry | 2/425 |
| 5,901,381 | A | * | 5/1999 | Nelson | 2/209.13 |
| 5,924,139 | A | | 7/1999 | Van Den Heuvel | |
| 6,056,624 | A | | 5/2000 | Fildan | |
| 6,101,636 | A | | 8/2000 | Williams | |
| 6,175,963 | B1 | | 1/2001 | Loeffelholz | |
| 6,237,162 | B1 | | 5/2001 | Gill | |
| 6,539,553 | B2 | * | 4/2003 | Day | 2/209.13 |

* cited by examiner

*Primary Examiner*—Rodney M. Lindsey
(74) *Attorney, Agent, or Firm*—Michael I Kroll

(57) ABSTRACT

A device is provided for attachment to the existing snap portions on a helmet such as a motorcycle helmet. Design elements are presented on a display member, and in some embodiments the display member extends across several helmet snap portions. One embodiment incorporates helmet accessories, such as visors, while still providing the outward presentation of the design elements on the display member.

8 Claims, 12 Drawing Sheets

MOTORCYCLE HELMUT SNAP-ON DECORATIVE DEVICE

BACKGROUND OF THE INVENTION

1. Field of the Invention

The present invention relates generally to decorative devices and, more specifically, to a snap on decorative device for motorcycle helmets.

2. Description of the Prior Art

There are other decorative helmet devices designed for said purpose. Typical of these is U.S. Pat. No. 4,156,292 issued to Helm, et al. on May 29, 1979.

Another patent was issued to Sewell-Wood on Sep. 16, 1980 as U.S. Pat. No. 4,222,125. Yet another U.S. Pat. No. 5,282,278 was issued to Miner on Feb. 1, 1994 and still yet another was issued on Aug. 22, 1995 to Miner as U.S. Pat. No. 5,442,817.

Another patent was issued to Herman on Aug. 6, 1996 as U.S. Pat. No. 5,542,157. Yet another U.S. Pat. No. 5,729,833 was issued to Judge on Mar. 24, 1998. Another was issued to Blackwelder on Sep. 8, 1998 as U.S. Pat. No. 5,803,266 and still yet another was issued on Jul. 20, 1999 to Van Den Heuvel as U.S. Pat. No. 5,924,139.

Another patent was issued to Fildan on May 2, 2000 as U.S. Pat. No. 6,056,624. Yet another U.S. Pat. No. 6,101,636 was issued to Williams on Aug. 15, 2000. Another was issued to Loeffelholz on Jan. 23, 2001 as U.S. Pat. No. 6,175,963 and still yet another was issued on May 29, 2001 to Gill as U.S. Pat. No. 6,237,162.

U.S. Pat. No. 4,156,292

Inventor: David P. Helm, et al.

Issued: May 29, 1979

A helmet capable of providing head protection and of carrying various accessories. The helmet includes a form-fit inner liner combined with a transparent mask, and an outer shell. The outer shell has a mount by which a display device may be carried. The display device has a flanged ocular end which snaps into a groove formed in the mask. The display device is carried on the mounts by a swivel-mount quick-disconnector. The outer shell may also carry such things as a visor and a radio microphone. The inner liner may carry earphones and may be adapted to connect to a gas mask.

U.S. Pat. No. 4,222,125

Inventor: Tom Sewell-Wood

Issued: Sep. 16, 1980

A method of making a cap and a cap made thereby. A plurality of panels each having an upwardly extending tapered portion are assembled into a cap with hems along the tapered edges of each panel sewn to the hems of adjacent panels to form the crown of the cap. The tapered portions of the panels are surface ornamented prior to assembly with a decoration having directionally oriented portions which cross the seam of the cap at a crossing angle other than perpendicular to the seams. The directionally oriented portions are extended across the hems to the tapered edges of said panel at an angle perpendicular to the tapered edges. When the panels are assembled into the crown of the cap, the extended directionally oriented portions on the hem of one panel are placed against corresponding extended directionally oriented portions on the hem of the adjacent panel before sewing the hems to each other, so that the directionally oriented portions on the panel one side of a seam will be in exact register with the directionally oriented portions on the panel on the other side of the seam. The directionally oriented portions of the surface ornamentation can be extended along the top surface of the visor of the cap.

U.S. Pat. No. 5,282,278

Inventor: Jon S. Miner

Issued: Feb. 1, 1994

An emblem bearing cap attachment has a substantially planar, relatively stiff body defining a forward surface and a rearward surface. A primary crease extends centrally across the planar body defining an upper facing panel and a lower backing panel. The primary crease facilitates folding of the body about and capturing the band of a baseball style cap to position the rearward surface of the facing panel in confronting relationship with the inside surface of the crown rearward portion whereat are fastening means to secure the backing panel to the cap. The facing panel allows the display of emblems or other indicia thereon whether the facing panel is folded upwardly or downwardly.

U.S. Pat. No. 5,442,817

Inventor: Jon S. Miner

Issued: Aug. 22, 1995

An emblem bearing cap attachment has a substantially planar, relatively stiff body defining a forward surface and a rearward surface. A primary crease or folding line extends centrally across the planar body defining an upper facing panel and a lower backing panel. The folding line facilitates folding of the body about and capturing the adjustable straps of a baseball style cap to position the rearward surface of the facing panel in confronting relationship with the rearward surface of the backing panel whereat are fastening means to secure the panels together. The facing panel completely closes the semicircular opening at the rear of the cap and allows the display of emblems or other indicia thereon.

U.S. Pat. No. 5,542,157

Inventor: Michael Herman

Issued: Aug. 6, 1996

Ornamental assemblies for buttons and athletic shoes are formed by snap-type action securing elements formed respectively on bases and ornamental caps so that a number of different caps can be removably attached to a single base to make a number of different assemblies. The assembly has a hollow cap element having top and sidewalls. The sidewalls have inner and outer surfaces which co-terminate at an edge lip. In one embodiment, a fabric-covered base is attached to the cap by means for snapping the base and the cap together. In another embodiment, the base is in the form of a projection molded to and extending from an athletic shoe.

U.S. Pat. No. 5,729,833

Inventor: Matthew J. Judge

Issued: Mar. 24, 1998

A cap having a tactile and visual identifier of the source of the cap. The cap includes a crown portion and a brim. The brim has a topside and an underside. An emblem is placed on the underside of the brim. In one embodiment, the emblem is embroidered onto the brim to produce a design which is raised from the surface of the brim. When a wearer dons, removes or adjusts the cap, the wearer's thumb naturally comes into contact with the raised emblem. The tactile feel of the emblem serves to identify to the user the emblem on the cap. Further, the emblem provides a constant visual indication to the wearer of the emblem on the cap.

U.S. Pat. No. 5,803,266

Inventor: Natalie A. Blackwelder

Issued: Sep. 8, 1998

An accessories kit for allowing a user to coordinate a clothing accessory with a variety of outfits without the expense of purchasing a separate clothing accessory for each outfit. The accessories kit includes a clothing accessory and a plurality of decorative, interchangeable ornaments for attachment to the clothing accessory. At least one of the ornaments is secured to the exterior surface of the clothing accessory by a VELCRO.RTM. fastener. The accessories kit further includes a storage container for conveniently organizing the clothing accessory and the plurality of ornaments therein. The ornaments are secured to the bottom surface of the storage container by a corresponding plurality of VELCRO.RTM. fasteners. The clothing accessory is secured to the bottom surface of the storage container, or to the opposed sides of the storage container by an elastic string.

U.S. Pat. No. 5,924,139

Inventor: Ernest A. Van Den Heuvel

Issued: Jul. 20, 1999

An attachment useful for a conventional type sports cap which has a fabric dome, a headband surrounding the dome, a pair of straps at the rear of the cap for adjustment of the size of the headband and an opening in the dome of the cap above the straps. The attachment has a planar member having a first surface, a second surface, a top area and an opposite bottom area. An indicia means is provided on the first surface for displaying a trademark and/or logo. At least one fastening means is provided on the top area of the second surface for removably fastening the attachment means to the fabric of the cap. There is at least one fastening member on the bottom area of the second surface for removably fastening the attachment to the strap of the cap. Preferably the fastening member is a hook member which hooks onto the straps. The planar member is of a size, and the fastening means and the fastening member are arranged on the second surface in such a manner, that when the fastening member is fastened to the straps and the fastening means is fastened to the fabric surrounding the opening, the attachment substantially covers the opening and the indicia means displays the trademark and/or logo.

U.S. Pat. No. 6,056,624

Inventor: Gerhard Fildan

Issued: May 2, 2000

A pin-and-eye connection is used to apply decorative members or stays or underwires, especially the foundation garments, utilizing a member which is stitched to the garment and preferably a cover member which conceals that stitching. Where the base is used as a decorative member, it can be provided with a circumference of pearl like formations.

U.S. Pat. No. 6,101,636

Inventor: Marix Williams

Issued: Aug. 15, 2000

A helmet, preferably a motorcycle helmet, having a latex or rubbery three dimensional sculpture generally following the contour of the helmet adhered to the outer surface thereof. The three dimensional structure is permanently adhered to the outer surface of the helmet, preferably with an epoxy adhesive. The helmets bears a striking decoration and are capable of enduring in the environment of use of motorcycle helmets. The structures seem to be a part of, or evolve from, the helmet, and make possible for the first time three dimensional images.

U.S. Pat. No. 6,175,963

Inventor: Glen M. Loeffelholz

Issued: Jan. 23, 2001

A system and method for detachably securing emblems, or the like, to articles of clothing, such as caps, hats, shirts, jackets, belts, and shoes. The system employs the combination of two magnetically attractive elements, for example, a magnet and a plate or a piece of ferromagnetic material. One or more magnets or pieces of the ferromagnetic material may be embedded in or adhesively attached to the clothing. Similarly, one or more magnets or pieces of the ferromagnetic material may be embedded in or attached to one or more emblems. The emblems are placed over selected ones of the magnetically attractive elements in the clothing, and thereby magnetically secured thereto. The method contemplates that a user may retrofit new or existing clothing, to enjoy the advantages of the present invention, without having to buy either new or specially manufactured clothing.

U.S. Pat. No. 6,237,162

Inventor: Roland Gill

Issued: May 29, 2001

A cover for a helmet includes a covering portion having side portions, a top portion, a lower elastic edge, and means for attaching the covering portion to the helmet. A covered helmet assembly includes a beanie-type motorcycle helmet with a removable, mating covering portion. The covering portion includes side portions and a top portion, and a lower, elastic edge. The covering portion further includes three female snap fastener portions on a front, interior surface thereof, spaced and adapted to mate with three similarly-positioned male snap fastener portions on a front, exterior surface of the motorcycle helmet. The covering portion also includes a selectively-releasable, mating hook and loop fabric patch pair wherein the loop portion is located on the covering portion's rear, interior surface and the hook portion is located on the helmet's rear, exterior surface. A visored, covered helmet assembly includes a helmet, a covering portion and a visor. The visor includes a horizontally-projecting peak, and a generally vertical flange. The flange includes an inner surface with three female snap fastener portions adapted to mate with the three male snap fastener portions on the helmet's front, exterior surface. The flange also includes three male snap fastener portions on its outer surface, adapted to mate with the three female snap fastener portions on the covering portion's front, interior surface.

While these devices may be suitable for the purposes for which they were designed, they would not be as suitable for the purposes of the present invention, as hereinafter described. What is needed is a decorative device that can be easily snap-fastened to one or more of the existing snap portions on a motorcycle helmet.

SUMMARY OF THE PRESENT INVENTION

A primary object of the present invention is to provide a snap-on decorative device for motorcycle helmets.

Another object of the present invention is to provide a snap-on decorative device for motorcycle helmets that customizes the helmet.

Yet another object of the present invention is to provide a snap-on decorative device for motorcycle helmets that adds integrity to the snaps of the device and the helmet.

Still yet another object of the present invention is to provide a snap-on decorative device for motorcycle helmets that are provided in a variety of styles and designs.

Another object of the present invention is to provide a snap-on decorative device for motorcycle helmets that is easily attached and removed.

Still yet another object of the present invention is to provide a snap-on decorative device for motorcycle helmets that attaches to the snaps located and provided on a motorcycle helmet and provides an O-ring for a tighter fit.

Another object of the invention is to provide a snap-on decorative device for motorcycle helmets that has either a planar or non-planar surface for the decorative design element.

Another object of the invention is to incorporate a helmet accessory such as a visor into the device.

Additional objects of the present invention will appear as the description proceeds.

The present invention overcomes the shortcomings of the prior art by providing a snap-on decorative device for motorcycle helmets that customizes the helmet The device also adds integrity to the snaps of the device and the helmet, and comes in a variety of styles. The devices are easily attached and removed, and attach to the existing snaps located and provided on a motorcycle helmet.

The snap-on devices are provided in a variety of styles depicting initials, armed forces emblems, characters, assorted stones, jewelry and limitless other decorative ideas.

There is provided, in combination with a helmet having at least one first snap portion, a snap device comprising: a second snap portion, the second snap portion being configured to snap-fasten to the first snap portion; and a display member attached to the second snap portion, the display member having a surface having a design element thereon.

In one embodiment, the device further comprises: an O-ring, the second snap portion having a groove for positioning the O-ring between the first snap portion and the second snap portion when the second snap portion has been snap-fastened to the first snap portion.

In one embodiment, the number of helmet first snap portions is at least two and the number of second snap portions is at least two, the second snap portions being aligned with the helmet first snap portions, and further wherein the display member extends and is attached to all the second snap portions.

In one embodiment, the number of helmet male snap portions and the number of female snap portions is three.

In one embodiment, the display member is flexible.

In one embodiment, the display member is flat and is generally straight, the female snap portions being of variable sizes to extend the display member at different distances from the helmet male snap portions.

In one embodiment, the display member surface is generally planar.

In one embodiment, the display member surface is non-planar.

My invention provides, in combination with a helmet having at least one snap portion, a device comprising: a display member, the display member having a surface having a design element thereon; and attachment means for attaching the display member to the helmet snap portion.

There is provided, in combination with a helmet having at least one male snap portion, the snap portion having a base and a male member, a snap device comprising: a female snap portion having a base and an outer female member and an inner female member, the outer and inner female members being concentrically oriented and spaced to closely receive and removably secure the helmet snap male member; and a display member attached to the female snap portion base, the display member having a surface having a design element thereon.

In one embodiment, the device further comprises: an O-ring, the female snap portion outer female member having a groove for positioning the O-ring between the outer female member and the helmet snap male member when the helmet snap male member has been received by the female snap portion.

In one embodiment, the number of helmet male snap portions is at least two and the number of female snap portions is at least two, the female snap portions being aligned with the helmet male snap portions, and further wherein the display member extends and is attached to all the female snap portions.

In one embodiment, the number of helmet male snap portions and the number of female snap portions is three.

In one embodiment, the display member is flexible.

In one embodiment, the display member is flat and is generally straight, the female snap portion bases being of variable sizes to extend the display member at different distances from the helmet male snap portions.

In one embodiment, the display member surface is generally planar.

In one embodiment, the display member surface is non-planar.

My invention provides, a device for attachment to a helmet, the helmet having at least one first snap portion, the device comprising: a helmet accessory; a center portion attached to and extending through the helmet accessory, the center portion having: a rearwardly facing second snap portion, the second snap portion being configured to snap-fasten to the first snap portion; and a frontwardly facing third snap portion; and a display member having a surface having a design element thereon, the display member having a fourth snap portion, the fourth snap portion being configured to snap-fasten to the third snap portion.

In one embodiment, the helmet accessory is a visor.

There is provided, a device for attachment to a helmet, the helmet having at least one snap portion, the device comprising: a helmet accessory; a center portion attached to and extending through the helmet accessory; a display member having a surface having a design element thereon; first attachment means for attaching the center portion to the helmet snap portion; and second attachment means for attaching the center portion to the display member.

In one embodiment, the helmet accessory is a visor.

My invention provides, a device for attachment to a helmet, the helmet having at least one male snap portion, the male snap portion having a base and a male member, the device comprising: a helmet accessory; a center portion attached to and extending through the helmet accessory, the center portion having: a rearwardly facing female snap portion having a base and an outer female member and an inner female member, the outer and inner female members being concentrically oriented and spaced to closely receive and removably secure the helmet snap male member; and a frontwardly facing male snap portion having a base and a male member; and a display member having a surface having a design element thereon, the display member having a female snap portion, the female snap portion having a base and an outer female member and an inner female member, the outer and inner female members being concentrically oriented and spaced to closely receive and removably secure the frontwardly facing male snap portion male member.

In one embodiment, the helmet accessory is a visor.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of the present invention in use. The present invention, a decorative snap-on device is designed to be attached to a motorcycle helmet via existing snaps provided on the helmet. Each snap on device are provided in a variety of styles depicting initials, armed forces emblems, characters, assorted stones, jewelry and limitless other decorative ideas. The snap on decorative devices are easily attached and removed when required.

Figure 4:
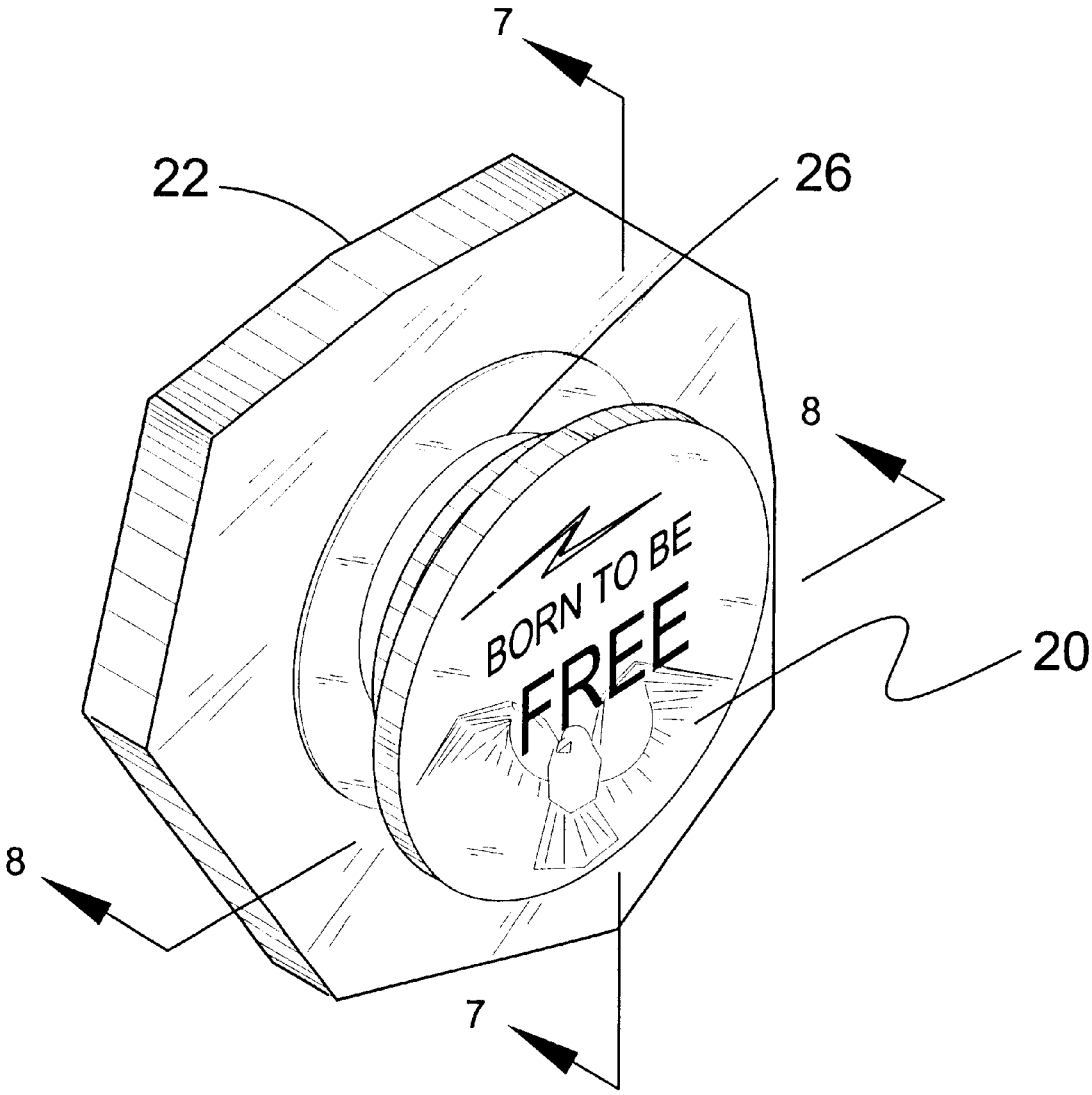

FIG. 4 is a perspective view of the present invention snapped to a helmet snap. The decoration or emblem displayed on the front surface of the snap on device can be of many different styles and designs. Each is interchangeable and can be removed and replaced as per the user's need.

Figure 5:
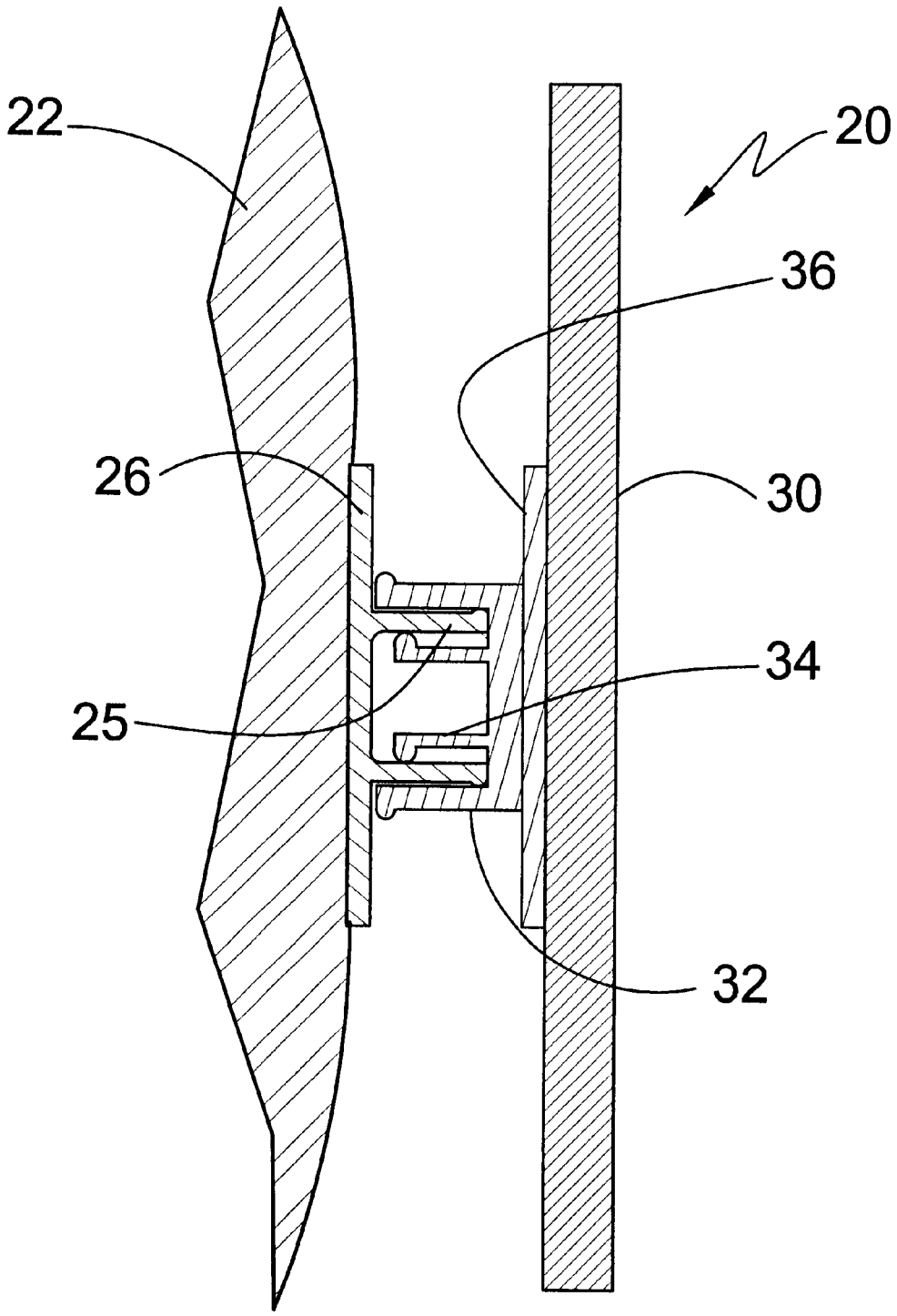

FIG. 5 is a sectional view of the present invention snapped to a helmet snap. The attachment of the decorative device to the snaps located on a motorcycle helmet is achieved by snapping together the device snap to its counter part located on the helmet.

Figure 6:
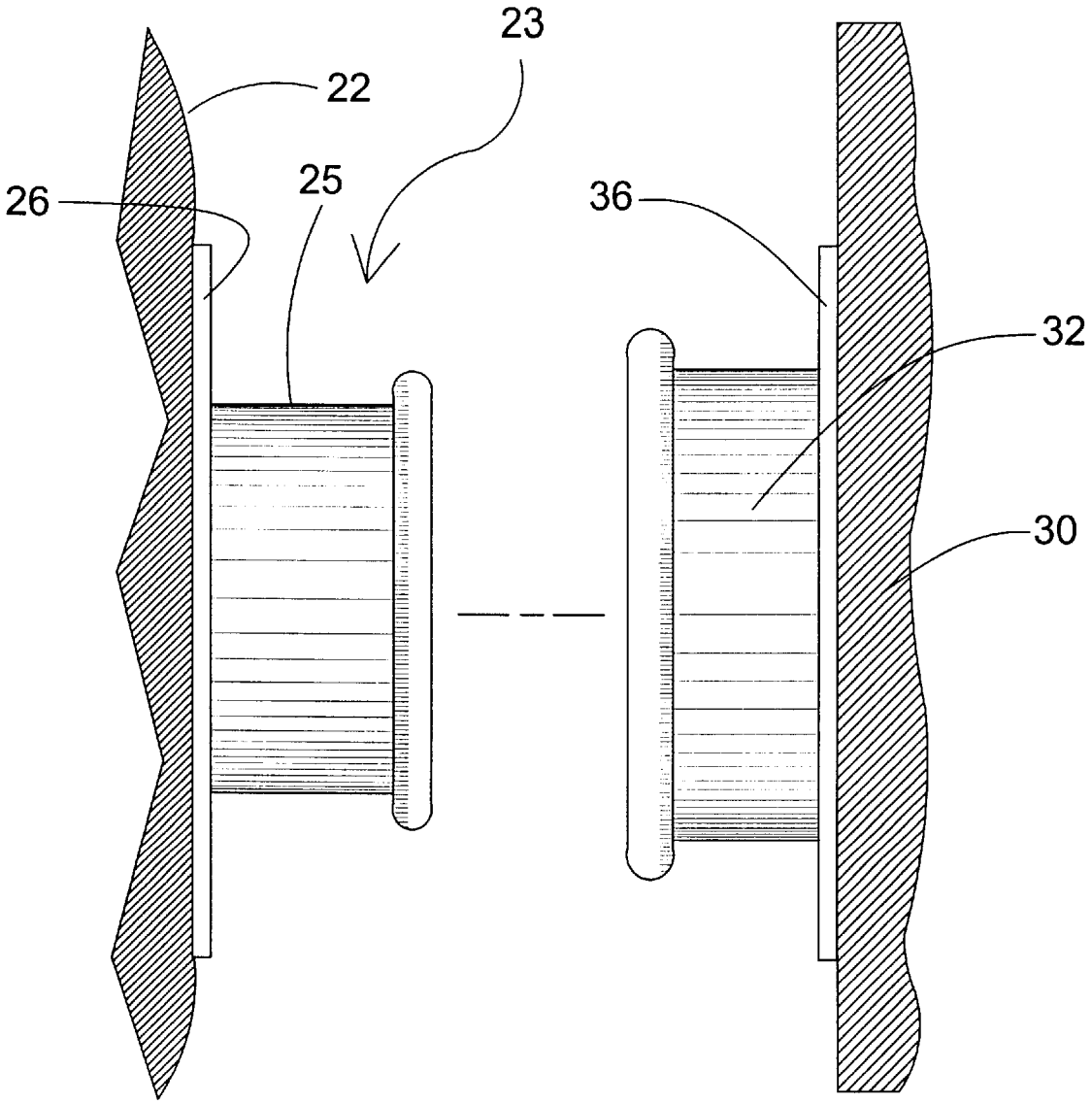

FIG. 6 is a side view of the present invention in position to be snap-fastened to the helmet.

Figure 7:
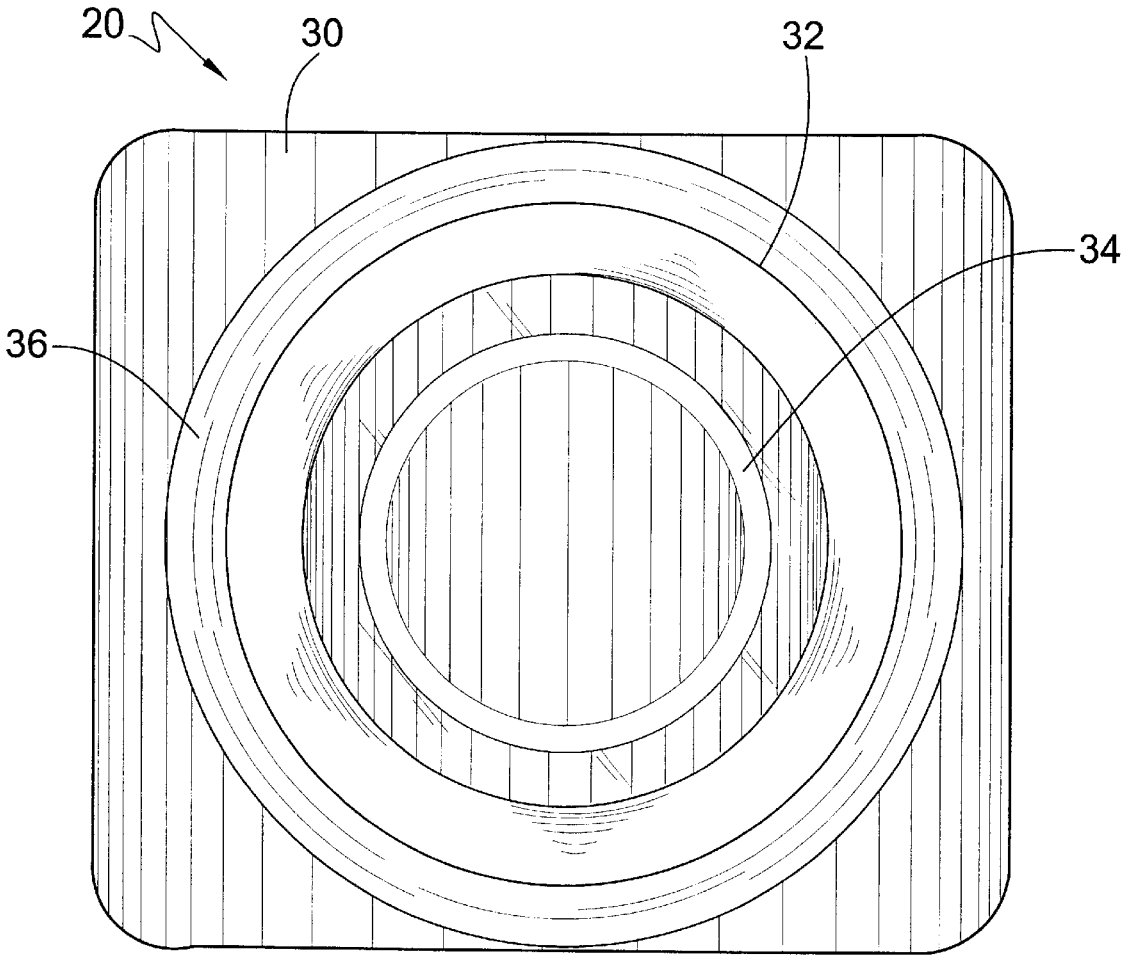

FIG. 7 is a rear view of the present invention.

Figure 8:
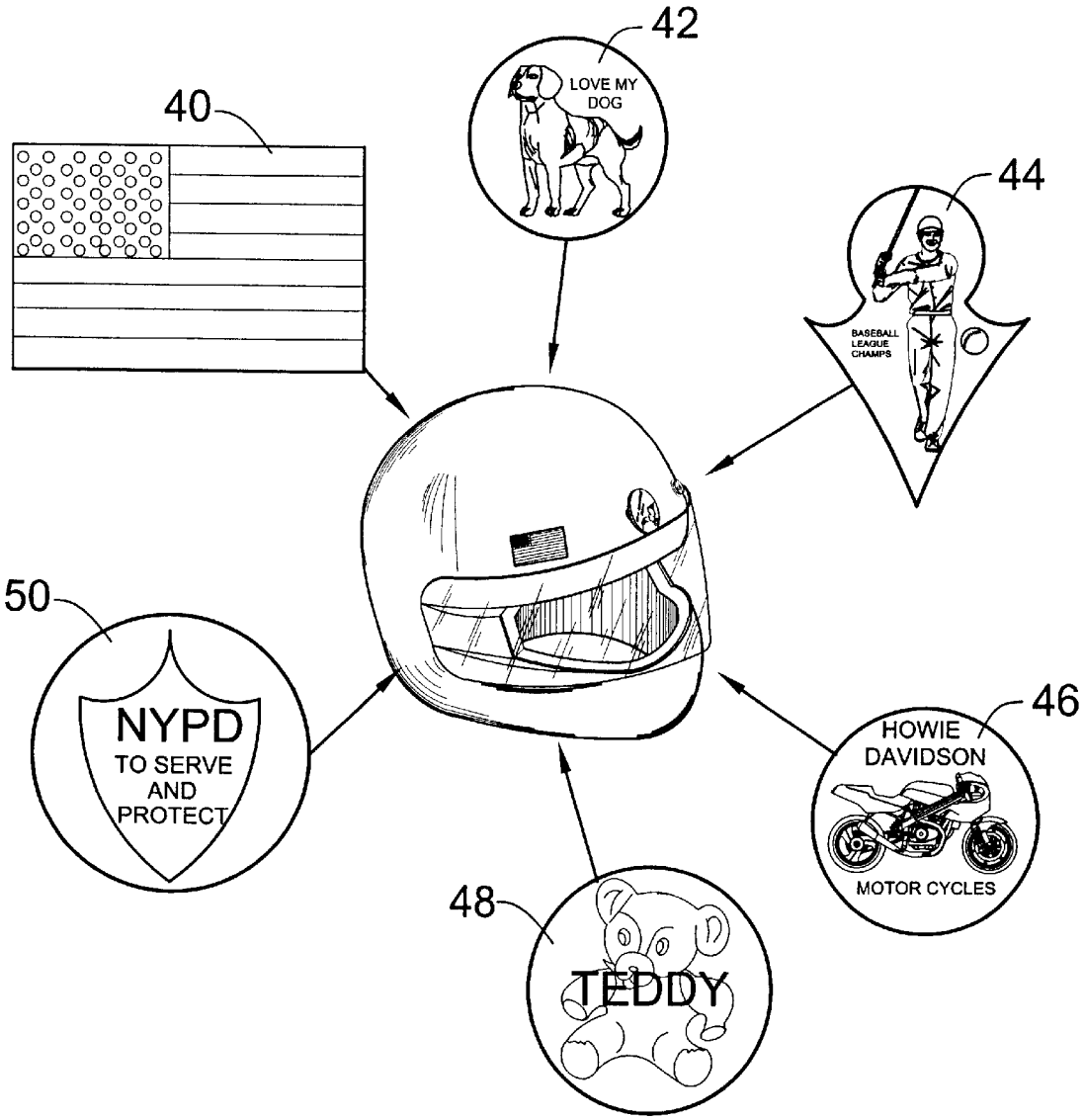

FIG. 8 is an illustrative view of various design elements of the present invention.

Figure 9:
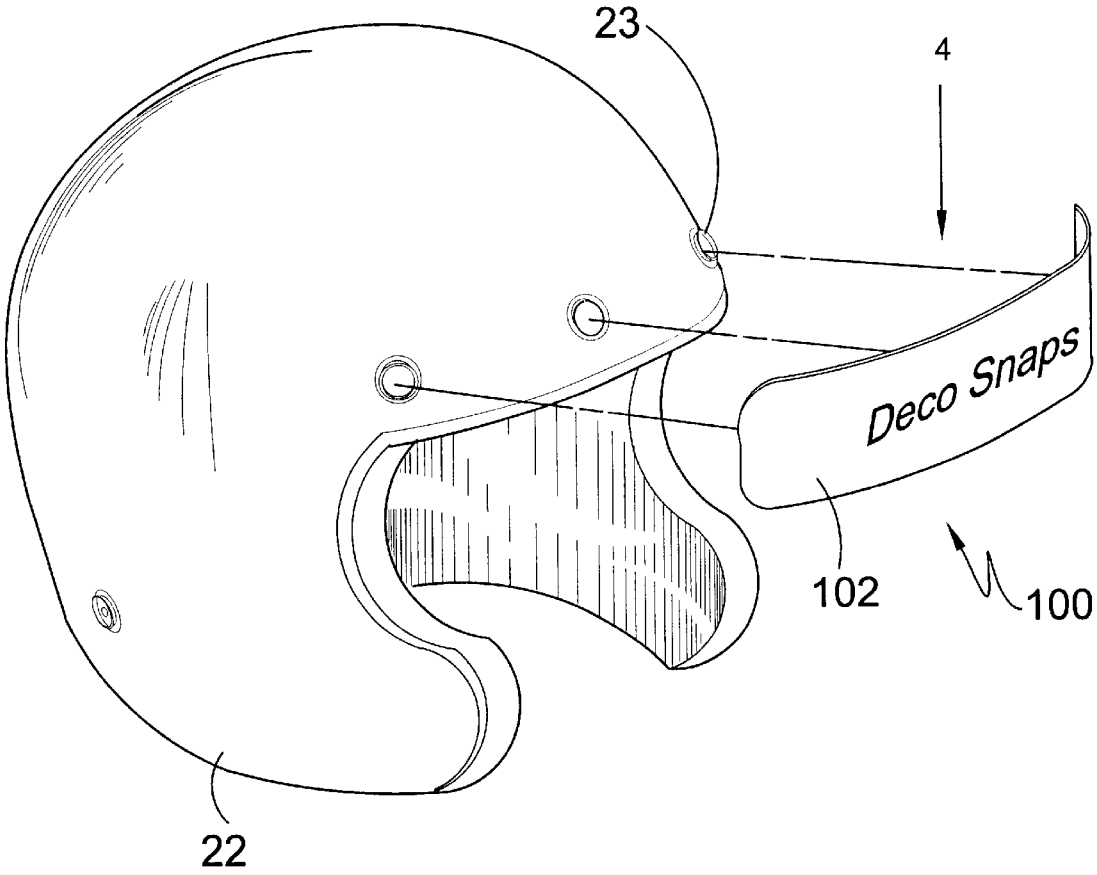

FIG. 9 is a perspective view of an alternate embodiment wherein the device extends across three helmet snaps.

Figure 10:
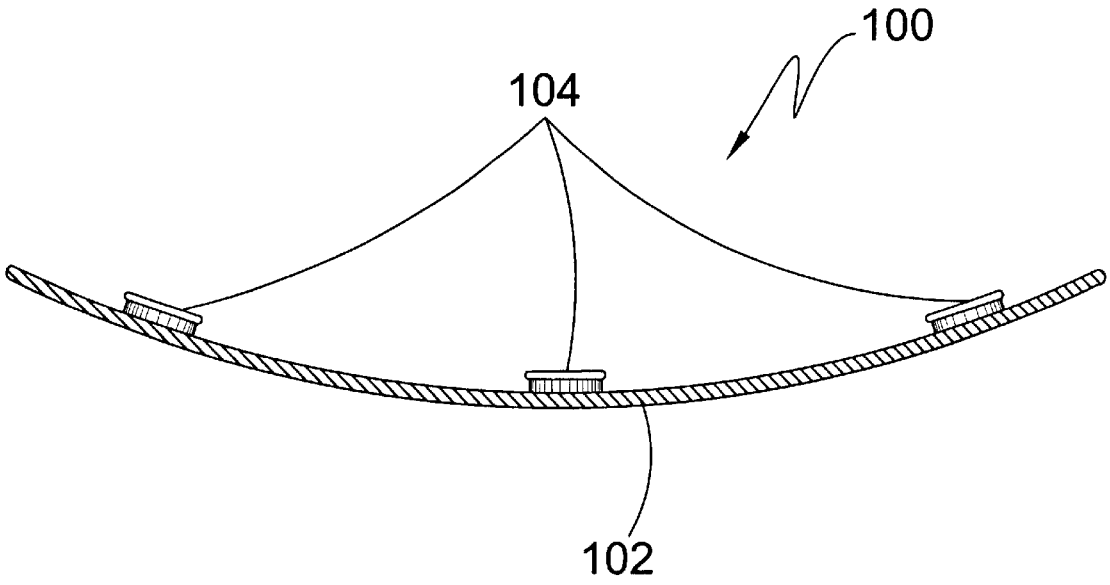

FIG. 10 is a top view of the alternate embodiment triple snap decorative device of the present invention.

Figure 11:
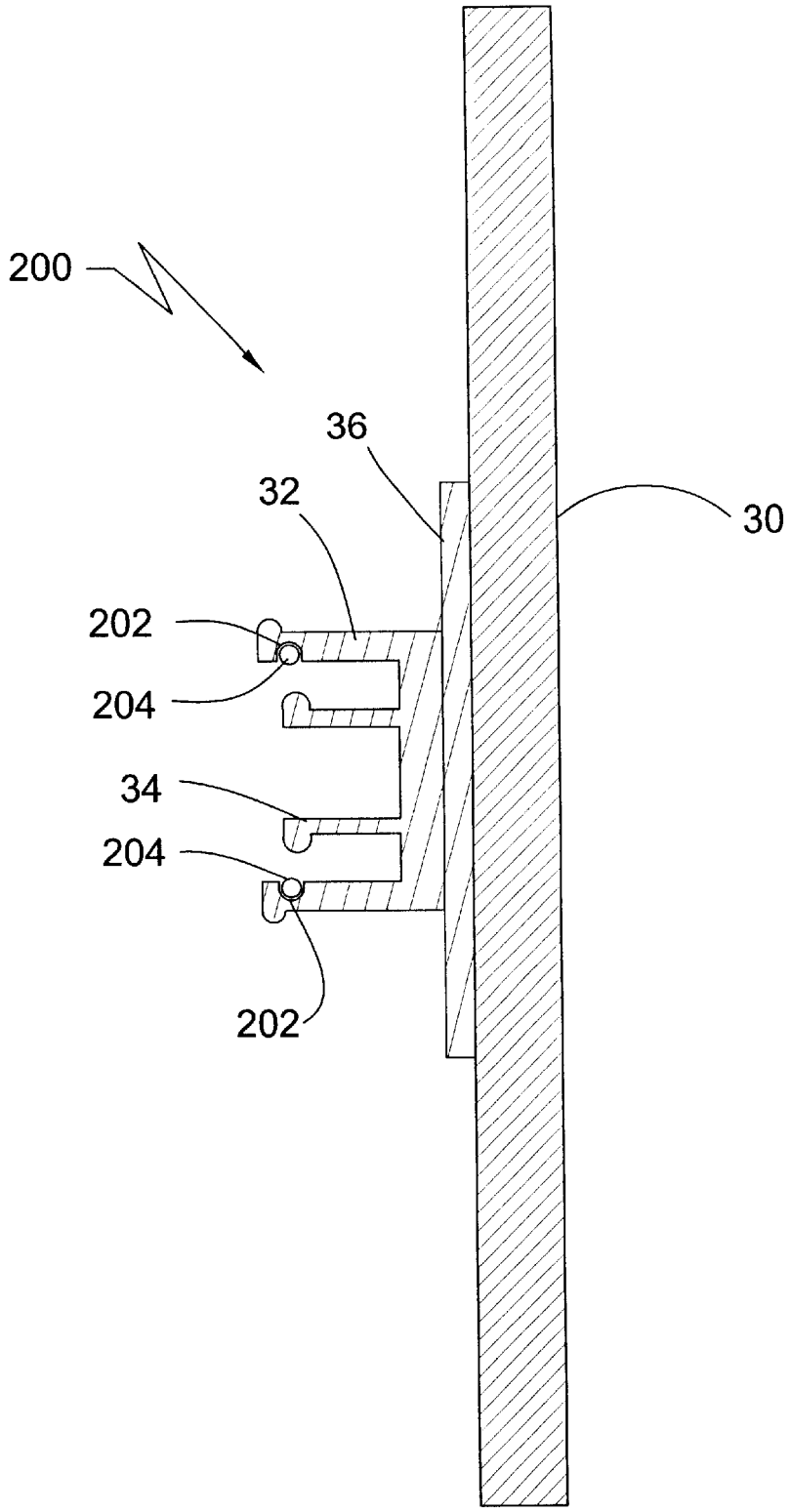

FIG. 11 is a side sectional view of an alternate embodiment using an O-ring.

Figure 12:
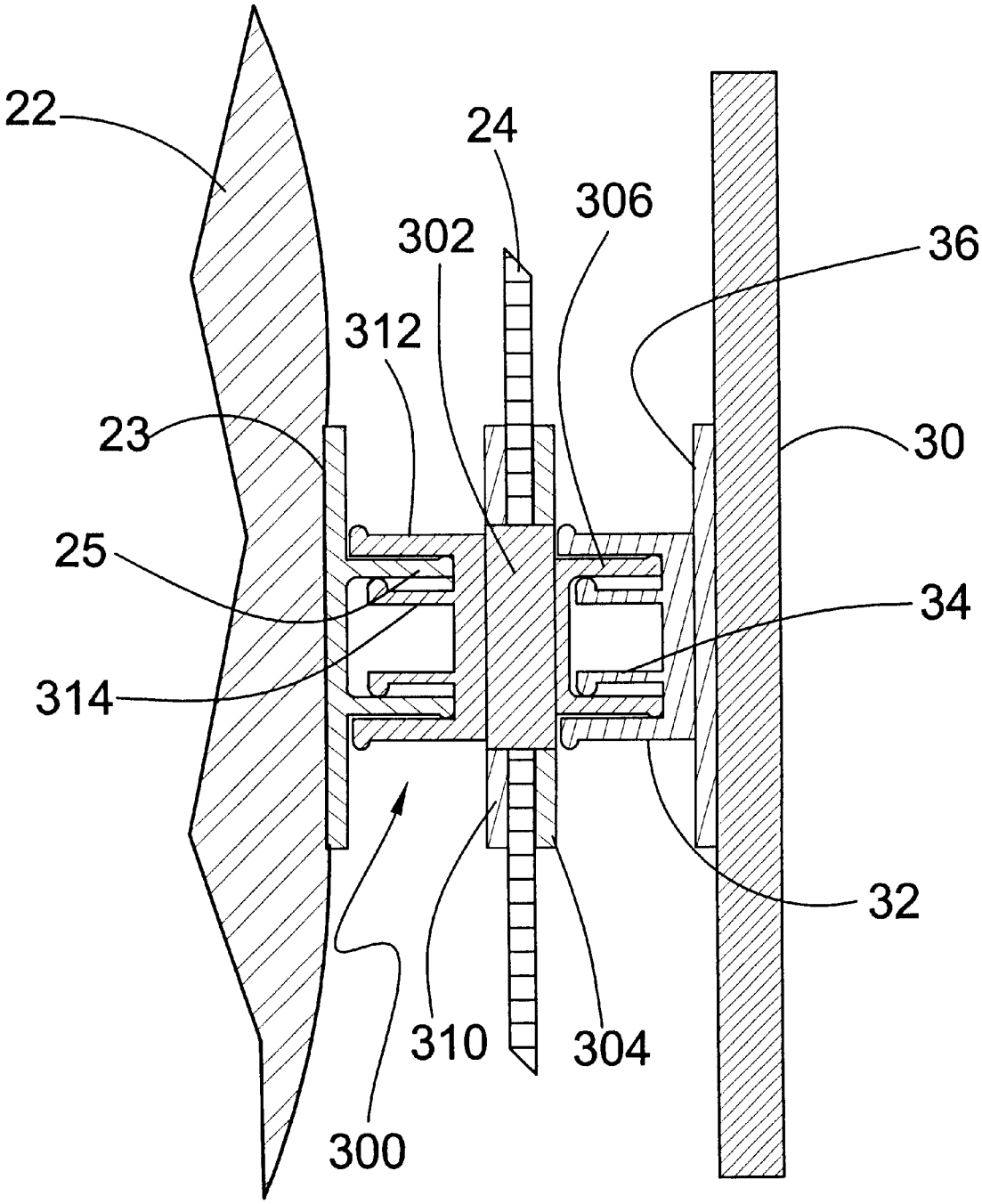

FIG. 12 is a side sectional view of an alternate embodiment incorporating a helmet accessory, such as a visor.

DESCRIPTION OF THE REFERENCED NUMERALS

Turning now descriptively to the drawings, in which similar reference characters denote similar elements throughout the several views, the figure illustrate the Helmet Snap-On Decorative Device of the present invention. With regard to the reference numerals used, the following numbering is used throughout the various drawing figures.

20 Helmet Snap-On Decorative Device of the present invention
21 user
22 helmet
23 helmet snap
24 helmet snap-on visor
25 helmet snap male member
26 helmet snap base
30 decorative front element
32 device snap outer female member
34 device snap inner female member
36 device snap base
40 design for decorative front element
42 design for decorative front element
44 design for decorative front element
46 design for decorative front element
48 design for decorative front element
50 design for decorative front element
100 alternate embodiment
102 decorative front element
104 snap plurality for alternate embodiment
200 alternate embodiment
202 device snap outer female member O-ring groove
204 O-ring
300 alternate embodiment
302 snap center portion
304 front snap base
306 front snap male member
310 rear snap base
312 rear snap outer female member
314 rear snap inner female member

DETAILED DESCRIPTION OF EXEMPLARY EMBODIMENTS OF THE INVENTION

The following discussion describes in detail the preferred embodiments of the invention. This discussion should not be construed, however, as limiting the invention to those particular embodiments. Practitioners skilled in the art will recognize numerous other embodiments as well. For a definition of the complete scope of the invention, the reader is directed to the appended claims.

As shown in FIGS. 1–8, a first embodiment of the Helmet Snap-On Decorative Device 20 is attached by the user 21 to a helmet 22, such as a motorcycle helmet 20, that has snaps 23 in place for helmet accessories such as a visor 24. When the visor 24 is removed the snaps 23 present a circular male member 25 on a base 26, the base 26 being attached to the helmet 22. As shown in FIG. 5, the device 20 has a display portion 30, as well as, a snap portion having a circular outer female member 32 and a circular inner female member 34 on a base 36. The female members 32, 34 are concentrically oriented and conventionally shaped to closely receive and secure the helmet snap male member 25, for firm placement until the user 21 removes by pulling the female members 32,34 from the male member 25.

As shown in FIG. 6, the helmet snap male member 25 and the device snap portion outer female member 32 are aligned in order to facilitate the smoothest joinder into the snapped position shown in FIG. 4.

Figure 1:
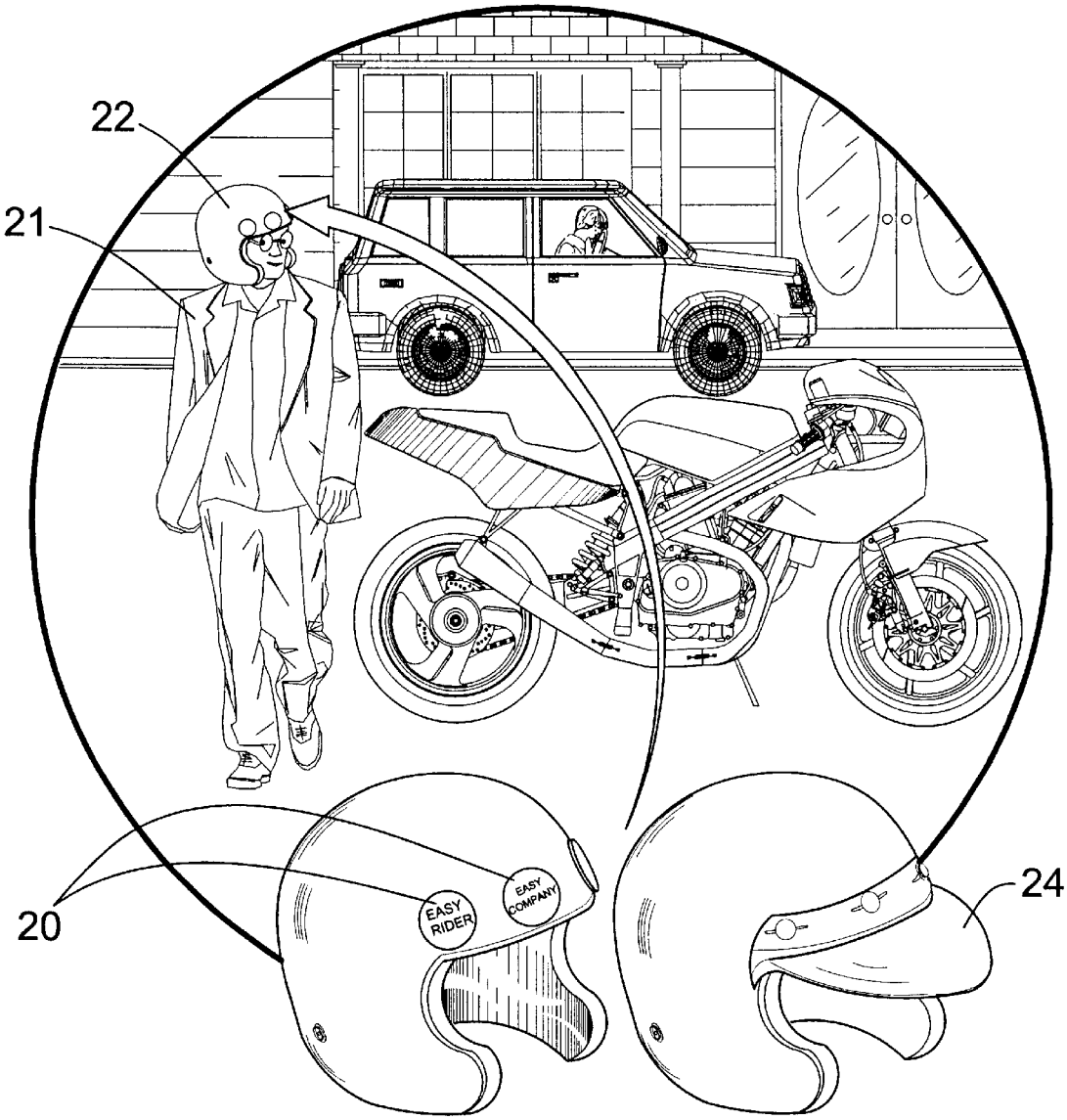
Figure 2:
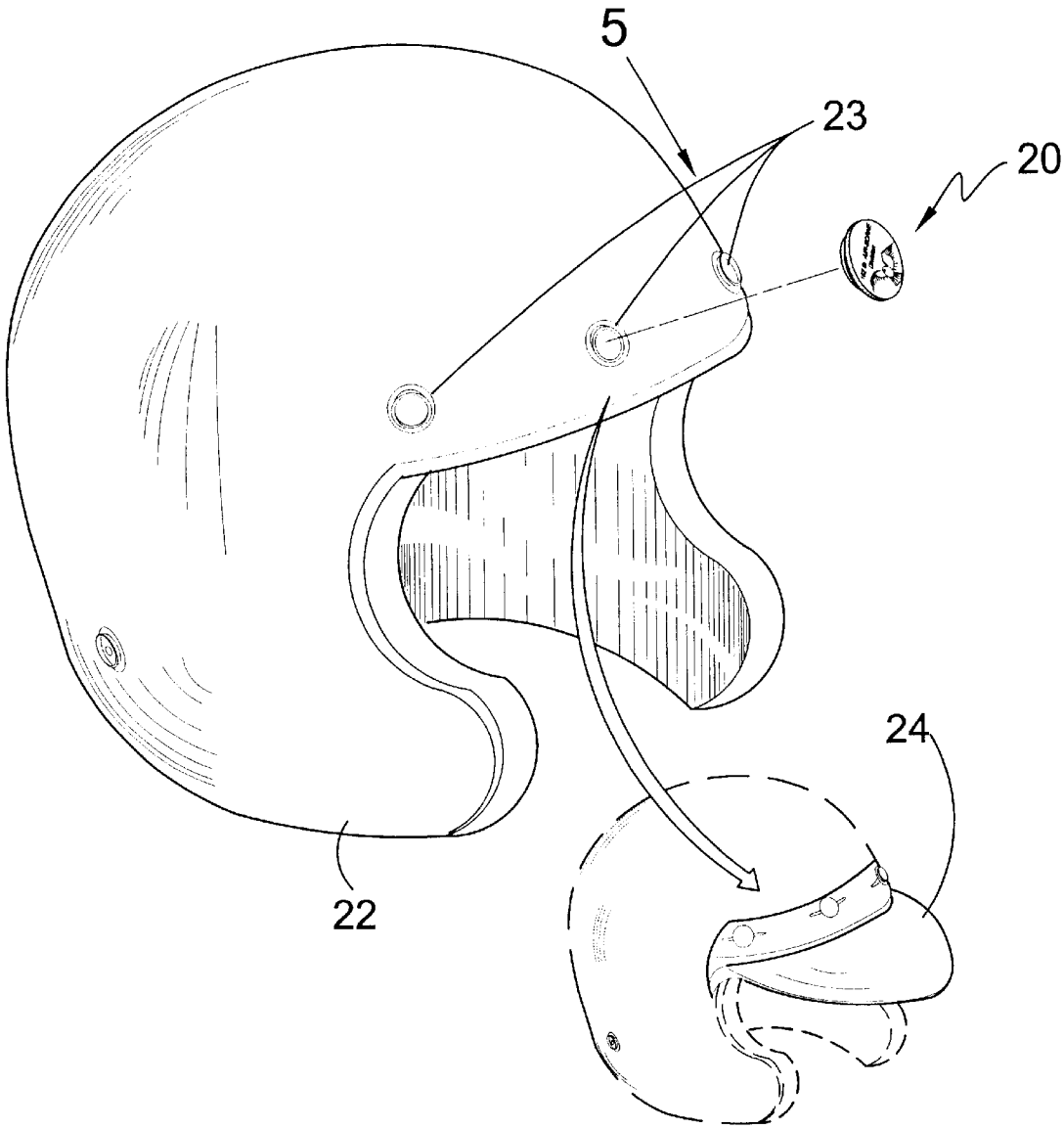
FIG. 2 is a perspective view of the present invention.
Figure 3:
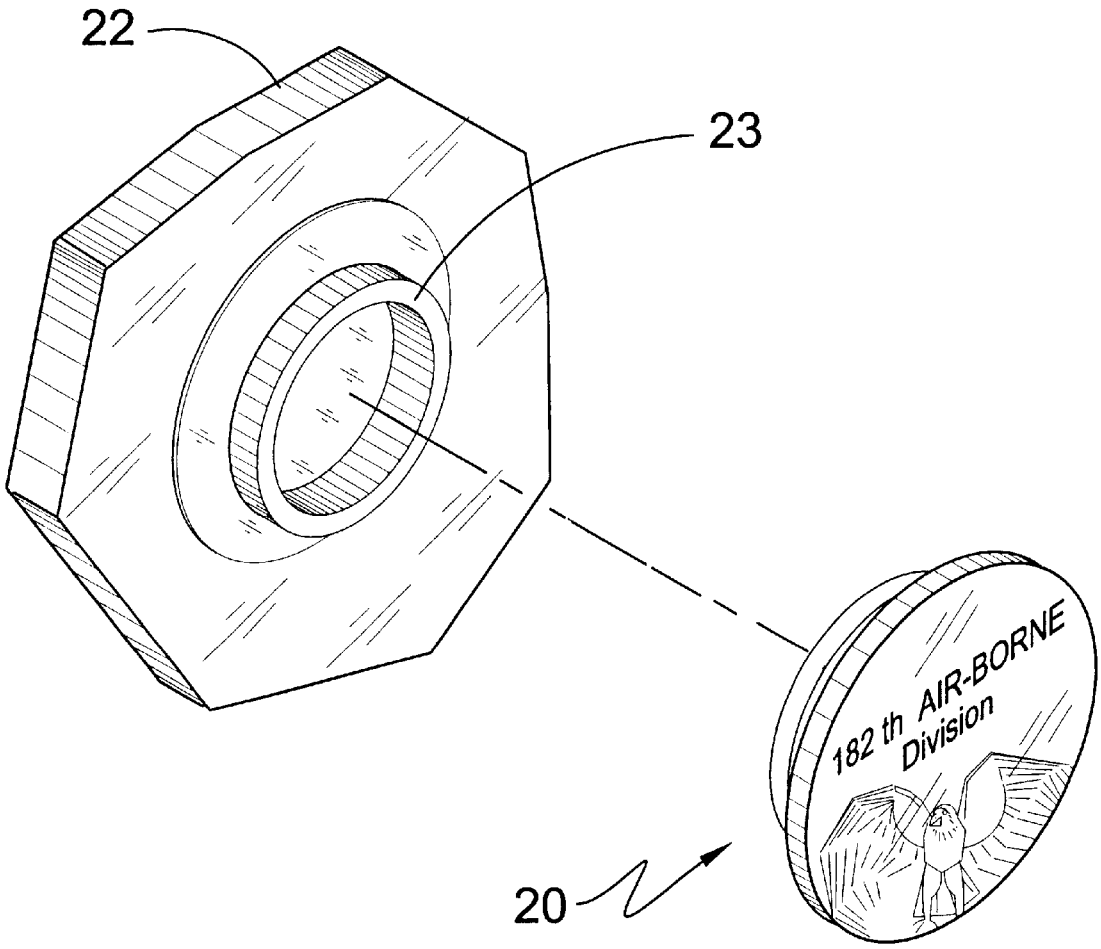
FIG. 3 is an illustrative view of the present invention showing the positioning of the device before snap-fastening to the helmet. The device is designed to accommodate a motorcycle rider, giving their helmets a custom look and a means to express themselves.

Attached to the snap portion base 36 is the display portion 30. As shown in FIG. 3 and FIG. 8, the display portion 30 has a generally planar surface for displaying decorative design elements such as the United States of America flag 40, a baseball sports FIG. 42, a motorcycle image 44, personal names 46, and law enforcement insignia 48.

In other embodiments, the display portion surface is non-planar and in some of such embodiments, the non-planarities conform to the design element chosen for display.

In another embodiment 100, shown in FIGS. 9–10, the display portion 102 is lengthened and joins a plurality of helmet snaps 23. This allows a significant expansion of the display portion 102 area available for design element display. The display portion 102 is flexible for close positioning to the helmet 22, however, in some embodiments the display portion remains flat with a corresponding increase in the thickness of the base 36 to accommodate the snap portions.

In another embodiment 200, shown in FIG. 11, the device snap portion outer female member 32 has a groove 202 to position an O-ring 204 in at least partial opposition to the end of the inner female member 34. This provides additional tightness when the helmet snap male member 25 is inserted.

In another embodiment 300, shown in FIG. 12 a snap-on helmet accessory such as a visor 24 is affixed to a center portion 302 that penetrates the visor 24. On the outward side of the center portion 302 is a base 304 with a snap male member 306 that corresponds in shape and function to the traditional helmet snap male member 25. This male member 306 is closely received and secured by the snap outer female member 32 and inner female member 34 on base 36, the base 36 being attached to a display portion 30, as discussed above.

On the inward side of the center portion 302 is a base 310 having a snap outer female member 312 and an inner female member 314 that closely receive and secure the helmet snap male member 25. This completes the attachment to the helmet 22.

This embodiment 300 allows the helmet accessory, such as the visor 24, to be utilized, and still present a snap male member 306 for snapping on the display portion 30. The display portion 30 is forward presented for the desired viewing by others, and the user 21 is still able to use the various snap-on helmet accessories. If no such accessories are desired the center portion 302 and the accessory can be removed and the display member 30 attached directly to the helmet 22, as in the above embodiments.

With respect to the above description then, it is to be realized that the optimum material and dimensional relationships for the parts of the Helmet Snap-On Decorative device 20, will include variations in size, materials, shape, and form, which will occur to those skilled in the art upon review of the present disclosure. For example, the snap members 22 are constructed from various plastics and metals typically used for helmet snaps, and the display portion 30 is constructed from various woods, metals, glasses and plastics, flat-surfaced and otherwise, that are deemed compatible with the design element chosen for display. All equivalent relationships to those illustrated in the drawings and described in the specification are intended to be encompassed by the present invention.

What is claimed as new and desired to be protected by Letters Patent is set forth in the appended claims:

1. In combination with a helmet having at least one first snap portion, a snap device comprising:

said first snap portion comprising a first base attached to an outer surface of said helmet and a male member comprising an annular ring extending away from said first base with a radially outwardly extending protuberance at a distal end of said annular ring, said first base and annular ring being a single integral component;

a second snap portion, the second snap portion being configured to snap-fasten to the first snap portion, said second snap portion comprising a second base with a female member on a first side of said second base, said female member comprising a pair of outer and inner annular rings extending from a bottom mounted on said first side of said second base, the outer one of said annular rings extending further than the inner one of said annular rings, said annular rings forming an annular slot adapted to receive the male member annular ring, distal ends of said annular rings having radially outwardly extending protuberances, said annular rings and bottom being a single integral component; and a display member attached to a second side of said second base of the second snap portion, the display member having a surface having a design element thereon.

2. The device of claim 1, further comprising an O-ring mounted in an annular groove on the inside of the outer annular ring of the female member adjacent to and offset from the radially outwardly extending protuberance thereon, the O-ring being positioned between the first snap portion and the second snap portion when the second snap portion has been snap-fastened to the first snap portion.

3. The device of claim 1, wherein there are at least two first and second snap portions, the second snap portions being aligned with the helmet first snap portions, and further wherein the display member extends and is attached to all the second snap portions.

4. The device of claim 3, wherein the display member is flexible.

5. The device of claim 1, wherein the display member surface is generally planar.

6. The device of claim 1, wherein the display member surface is non-planar.

7. In combination with a helmet having a plurality of first snap portions, a snap device comprising:

each first snap portion comprising a first base attached to an outer surface of said helmet and a male member comprising an annular ring extending away from said first base with a radially outwardly extending protuberance at a distal end of said annular ring, said first base and annular ring being a single integral component;

an accessory having a center portion;

a plurality of second snap portions mounted on a first side of said center portion, each second snap portion being configured to snap-fasten to a first snap portion, each second snap portion having a female member comprising a pair of outer and inner annular rings extending from a bottom mounted on said first side of said center portion, the outer one of said annular rings extending further than the inner one of said annular rings, said annular rings forming an annular slot adapted to receive a male member annular ring, distal ends of said annular rings having radially outwardly extending protuberances, said annular rings and bottom being a single integral component;

a third snap portion comprising a second base attached to an outer surface of a second side of said central portion and a male member comprising an annular ring extending outwardly from said second base with a radially extending protuberance at a distal end thereof, said second base and annular ring being a single integral component;

a fourth snap portion, said fourth snap portion being configured to snap-fasten to said third snap portion, said fourth snap portion comprising a third base with a female member on a first side of said third base, said female member comprising a pair of outer and inner annular rings extending from a bottom mounted on one side of said third base, the outer one of said annular rings extending further than the inner one of said annular rings, said annular rings forming an annular slot adapted to receive the male member annular ring of said third snap portion, distal ends of said annular rings having radially outwardly extending protuberances, said annular rings and bottom of said fourth snap portion being a single integral component; and a display member attached to a second side of said third base of said fourth snap portion, the display member having a surface having a design element thereon.

8. The device of claim 7, wherein the accessory is a visor.

* * * * *